US007573197B2

(12) United States Patent
Lee

(10) Patent No.: US 7,573,197 B2
(45) Date of Patent: Aug. 11, 2009

(54) PLASMA DISPLAY PANEL WITH BUS ELECTRODES OF THE SCAN/SUSTAIN ELECTRODES

(75) Inventor: Sang Kook Lee, Gumi-si (KR)

(73) Assignee: LG Electronics Inc., Seoul (KR)

( * ) Notice: Subject to any disclaimer, the term of this patent is extended or adjusted under 35 U.S.C. 154(b) by 257 days.

(21) Appl. No.: 11/276,663

(22) Filed: Mar. 9, 2006

(65) Prior Publication Data

US 2007/0052358 A1 Mar. 8, 2007

(30) Foreign Application Priority Data

Sep. 8, 2005 (KR) ..... 10-2005-0083770

(51) Int. Cl.
*H01J 17/49* (2006.01)

(52) U.S. Cl. ..... 313/582; 313/585

(58) Field of Classification Search ..... 313/582–587
See application file for complete search history.

(56) References Cited

U.S. PATENT DOCUMENTS

| | | | |
|---|---|---|---|
| 6,873,103 | B2 | 3/2005 | Takada et al. |
| 2002/0084750 | A1 | 7/2002 | Su |
| 2005/0041001 | A1 | 2/2005 | Sumida |
| 2006/0033437 | A1 * | 2/2006 | Eom ..... 313/586 |

FOREIGN PATENT DOCUMENTS

| | | |
|---|---|---|
| CN | 1542893 A | 11/2004 |
| EP | 1 220 266 | 7/2002 |
| EP | 1 355 339 | 10/2003 |
| JP | 2002-134035 | 5/2002 |
| JP | 15-308784 | 10/2003 |

OTHER PUBLICATIONS

European Search Report dated Sep. 25, 2008 for Application No. 06003604.3, 5 pages.
Chinese Office Action dated Jan. 23, 2009 for Chinese Patent Application No. 2006100071404.5 (8 pages).

* cited by examiner

*Primary Examiner*—Joseph L Williams
(74) *Attorney, Agent, or Firm*—Fish & Richardson P.C.

(57) ABSTRACT

A plasma display panel according to an aspect of the present invention includes a scan electrode and a sustain electrode formed on an upper substrate in parallel with each other, a first barrier rib formed on a lower substrate opposing the upper substrate in parallel with the scan electrode, and a second barrier rib formed in the direction intersecting the first barrier rib, wherein the scan electrode or the sustain electrode comprises at least two or more bus electrodes, at least one of the bus electrodes is formed to be superposed onto the first barrier rib. Therefore, there is an advantage that the brightness is increased, since the area of portions of the bus electrode formed on the discharge space is small and thus the aperture ratio is raised. In addition, the boundary image sticking phenomenon and luminescent spot phenomenon in the non-discharge cell by cross-talk with neighboring cells can be reduced, since the area of portions of the electrode superposed onto the first barrier rib is also decreased. Therefore there are effects that it is possible to improve the discharge efficiency and display images with sharper and clearer image quality.

17 Claims, 5 Drawing Sheets

PLASMA DISPLAY PANEL WITH BUS ELECTRODES OF THE SCAN/SUSTAIN ELECTRODES

BACKGROUND OF THE INVENTION

1. Field of the Invention

The present invention relates to a plasma display apparatus, and more particularly to a plasma display apparatus, which may reduce manufacturing costs and at the same time enhance discharge characteristic and discharge efficiency by improving scan electrode structure and sustain electrode structure.

2. Description of the Background Art

In general, a plasma display panel (hereinafter referred to as a PDP) displays images including characters or graphics by light-emitting phosphors using 147 nm vacuum ultraviolet generated during discharging inert mixture gas, such as He+Xe, Ne+Xe, or He+Xe+Ne. The PDP can be easily manufactured to be thin and large and provide highly improved image quality along with the recent development of PDP techniques. Specifically, in a three-electrode AC surface discharge PDP, since wall charges are accumulated on its surface when discharge occurs and electrodes are protected from sputtering caused by the discharge, low voltage driving and long lifespan are achieved.

The conventional plasma display panel has two types, one of which includes both a transparent electrode and a bus electrode (metal electrode), and the other includes only a bus electrode to form a scan electrode and a sustain electrode and drive the panel.

FIG. 1 is a view of illustrating a conventional plasma display panel structure, and FIG. 2 is a view of illustrating a conventional ITO-less plasma display panel structure.

The conventional plasma display panel includes a scan electrode and a sustain electrode formed on the upper substrate, and an address electrode formed on the lower substrate.

The scan electrode and the sustain electrode are made of transparent electrodes Y1, Z1 and metal bus electrodes Y, Z.

In FIG. 1, the transparent electrodes Y1, Z1, which are made of ITO (Indium-Tin-Oxide) on the upper substrate, serve to reduce discharge gap (G) between the electrodes. The metal bus electrodes Y, Z, which are generally made of well-conductive metals such as Cr, Ag, Cu, etc. on the transparent electrodes Y1, Z1, serve to reduce voltage drop by the high resistive transparent electrodes. The metal bus electrodes are made of one metal, or two or more metal layers to prevent the diffusion into the upper dielectric layer.

Transverse barrier ribs 1 and vertical barrier ribs 2 are formed on the lower substrate to define a discharge cell. The transverse barrier ribs 1 are formed in parallel with the scan bus electrode Y or sustain bus electrode Z, and the vertical barrier ribs 2 are formed in parallel with the address electrode.

As the discharge gap G is increased, the discharge efficiency is improved. However, there is a disadvantage that discharge voltage is raised accordingly.

In the conventional plasma display panel, if the transparent electrode is provided, the scan bus electrode Y and sustain bus electrode Z are formed to be partially superposed onto the barrier ribs as shown in FIG. 1, and if the transparent electrode is not provided, the bus electrodes are formed within a discharge space as shown in FIG. 2 to reduce discharge voltage.

At this time, there is a problem that if a part of the bus electrodes Y, Z is formed to be partially superposed onto the transverse barrier ribs 1, then brightness is increased, however, luminescent spot or boundary image sticking phenomenon occurs in the neighboring non-discharge (OFF) cell region by cross-talk.

In addition, there is also problem that if the bus electrodes Y, Z are formed within the discharge space as shown in FIG. 2, then discharge voltage can be lowered, however, brightness is reduced since the aperture ratio of discharge cell is lowered.

SUMMARY OF THE INVENTION

The present invention is designed to solve the problems of the prior art, and therefore an object of the present invention is to provide a plasma display panel which may improve discharge efficiency, brightness as well as image quality by forming the scan bus electrode or sustain bus electrode with at least two or more electrodes having narrow widths, one part of which is formed to be superposed onto barrier ribs, and the other is formed within a discharge space.

A plasma display panel according to an aspect of the present invention includes a scan electrode and a sustain electrode formed on an upper substrate in parallel with each other, a first barrier rib formed on a lower substrate opposing the upper substrate in parallel with the scan electrode, and a second barrier rib formed in the direction intersecting the first barrier rib, wherein the scan electrode or the sustain electrode includes at least two or more bus electrodes, at least one of the bus electrodes is formed to be superposed onto the first barrier rib.

The others of the bus electrodes are formed on a discharge space.

In addition, each of the bus electrodes is formed to substantially have the same width.

And, each of the bus electrodes is formed spaced in parallel with one another by a predetermined interval.

In addition, the interval between the bus electrodes may be formed to be narrower than the width of each of the bus electrodes.

The plasma display panel further includes a connection electrode for connecting each of the bus electrodes to one another.

The connection electrode is formed in parallel with the second barrier rib.

In addition, the connection electrode is formed to be superposed onto the second barrier rib.

A plasma display panel according to a second aspect of the present invention comprises a scan electrode and a sustain electrode formed on an upper substrate in parallel with each other; and barrier ribs formed on a lower substrate opposing the upper substrate, wherein at least either one of the scan electrode or the sustain electrode includes a bus electrode group consisting of at least two or more bus electrodes.

<DESCRIPTIONS FOR KEY ELEMENTS IN THE DRAWINGS>

| | |
|---|---|
| 10: transverse barrier rib | 20: vertical barrier rib |
| 30a: first bus electrode | 30b: second bus electrode |
| 30c: connection electrode | 40: discharge cell |
| 30d, 30d1, 30d2: transparent electrode | |
| Wr1: width of the transverse barrier rib | |
| Wr2: width of the vertical barrier rib | |
| W1: width of the first or the second bus electrodes | |
| W2: interval between the first bus electrode and the second bus electrode | |

DESCRIPTIONS DESCRIPTION OF PREFERRED EMBODIMENTS

Hereafter, preferred embodiments of the present invention will be described in a more detailed manner with reference to the accompanying drawings.

The present invention may be applied to at least either one of a scan electrode or a sustain electrode, and the scan electrode or sustain electrode includes a bus electrode group consisting of at least two or more bus electrodes. Hereafter, an embodiment of the case where a scan electrode or a sustain electrode has a first bus electrode and a second bus electrode will be described below, but is not limited thereto.

Figure 1:
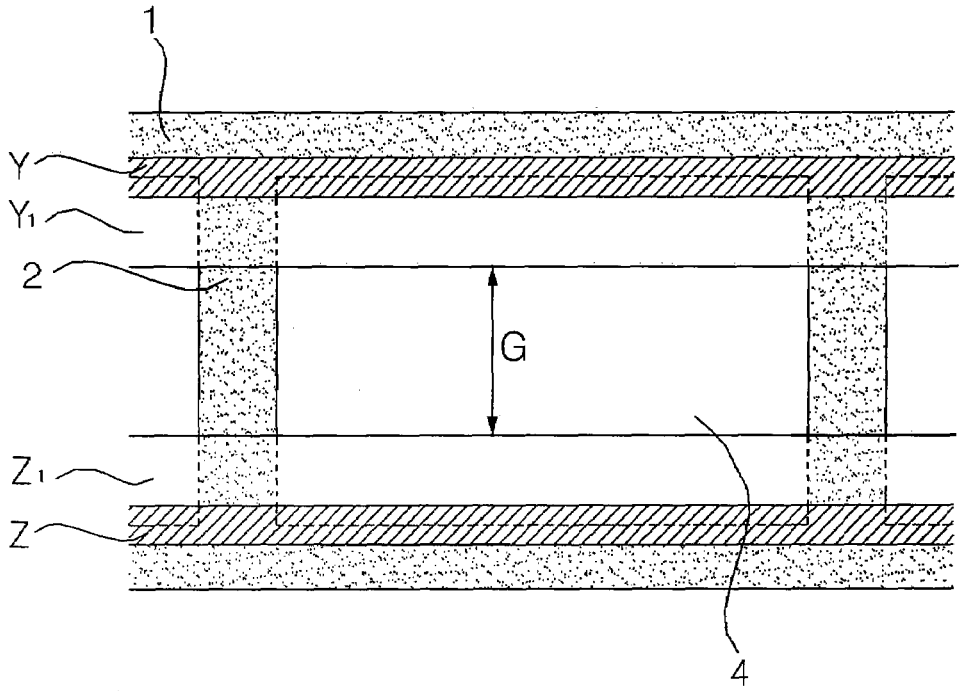
Fig.1 (related art)
FIG. 1 is a view of illustrating an electrode structure of a general plasma display panel.
Figure 2:
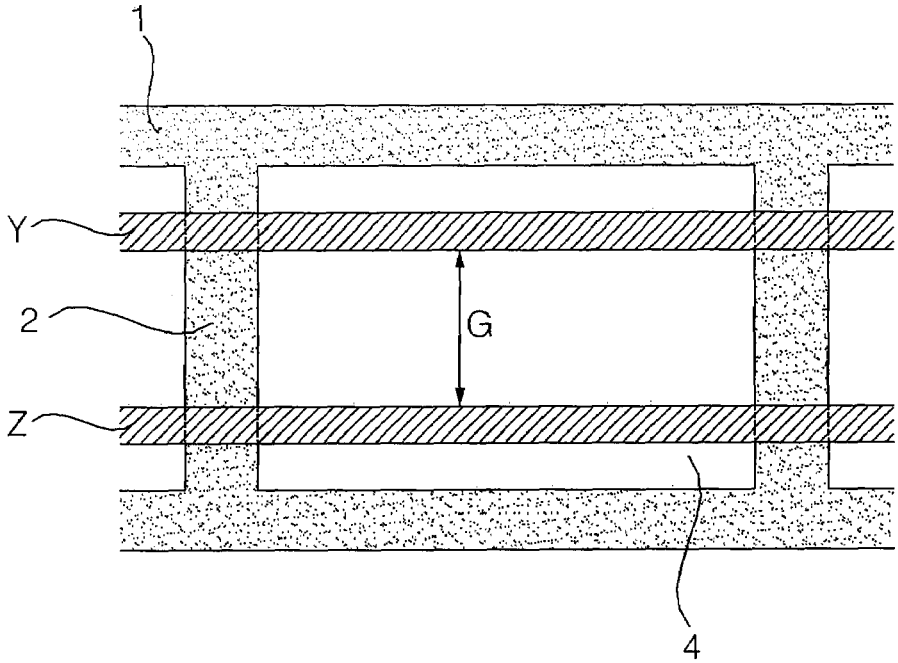
Fig.2 (related art)
FIG. 2 is a view of illustrating an electrode structure of a general ITO-less plasma display panel.
Figure 3A:
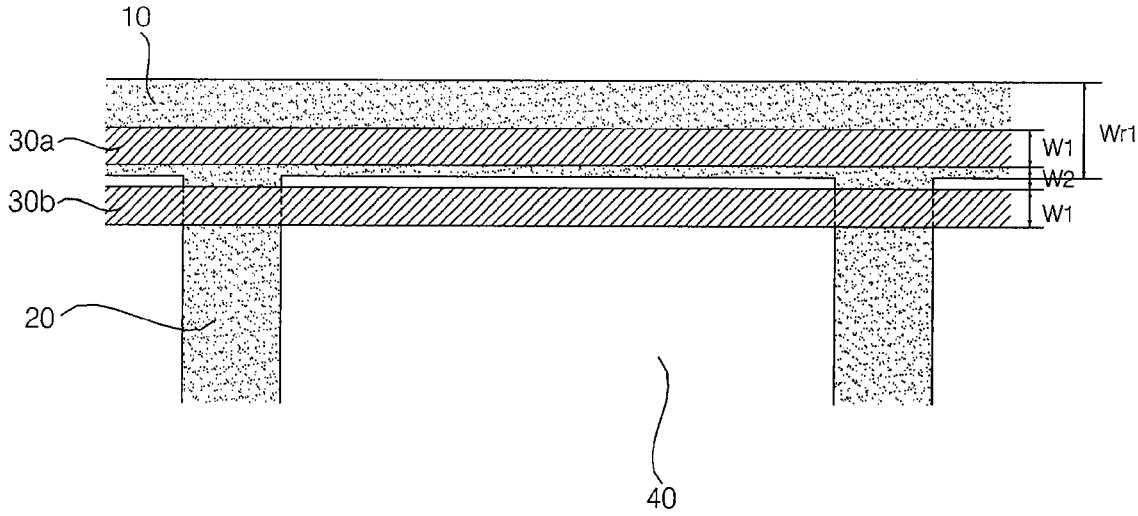
FIG. 3A is a view of illustrating an electrode structure of a plasma display panel according to a first embodiment of the present invention.
Figure 3B:
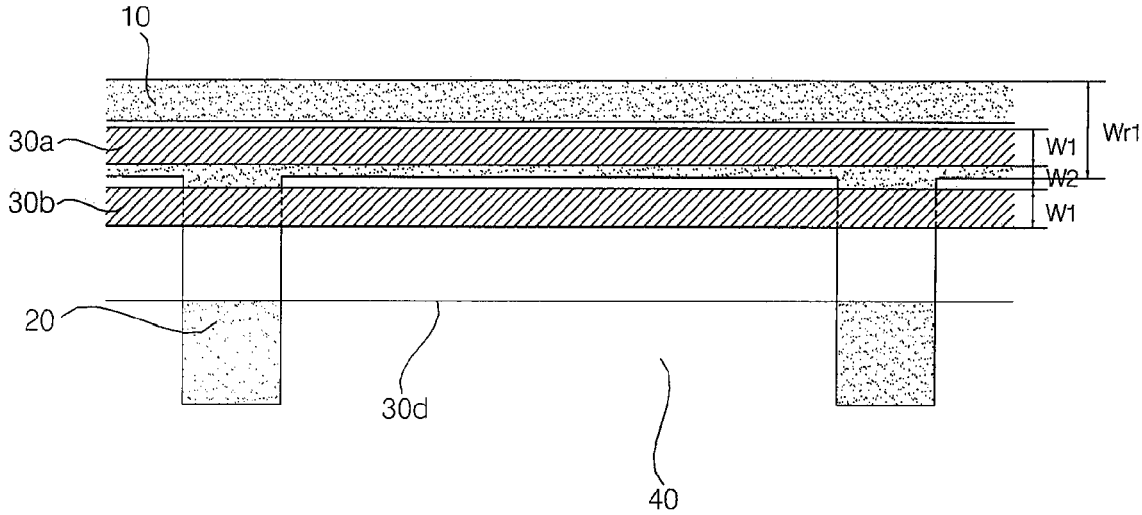
FIG. 3B is a view of illustrating an electrode structure in which transparent electrodes are formed on bus electrodes according to a first embodiment of the present invention.

FIG. 3A is a view of illustrating an electrode structure of a plasma display panel according to a first embodiment of the present invention, which illustrates a figure through which electrodes and barrier ribs are seen from the upper substrate, and FIG. 3B is a view of illustrating an electrode structure in which transparent electrodes are formed on bus electrodes according to a first embodiment of the present invention.

Although either one of the scan electrode and sustain electrode is shown in FIGS. 3A and 3B, the other is also formed in the same structure (the other drawings to be described hereinafter are also applicable similarly).

Referring to FIG. 3A, a first embodiment of a plasma display panel according to the present invention includes a scan electrode and a sustain electrode formed on an upper substrate in parallel with each other, a first barrier rib 10 formed on a lower substrate opposing the upper substrate in parallel with the scan electrode, and a second barrier rib 20 formed in the direction intersecting the first barrier rib.

In addition, each of the scan electrode and sustain electrode comprises a first bus electrode 30*a*, which is formed on the upper side of the transverse barrier rib 10 to be completely superposed onto the first barrier, and a second bus electrode 30*b*.

Here, a width W1 of the first bust electrode is formed to be narrower than that Wr1 of the transverse barrier rib.

The second bus electrode 30*b* is formed spaced in parallel with the first bus electrode 30*a* by a predetermined interval W2 on the discharge space, and the interval W2 is formed to be narrower than the width W1 of the first bus electrode.

As described above, if the interval between the first bus electrode 30*a* and the second bus electrode 30*b* is narrowed, the distance between the first bus electrode formed in the scan electrode and the second bus electrode formed in the sustain electrode is widened, thus making it possible to improve the brightness and efficiency.

It is preferred that the second bus electrode 30*b* is formed to have the same width as that of the first bus electrode, but is not limited thereto.

Assuming that the conventional bus electrode has a width of 100 μm, the first and second bus electrodes are formed to have a width W1 of approximately 30~50 μm, respectively, which is narrower than that of the conventional bus electrode, and the interval between the first bus electrode and the second electrode is formed to be less than approximately 15~25 μm in the first embodiment according to the present invention. Preferably, the width of the bus electrode is 40 μm and the interval between the first electrode and the second electrode is 20 μm.

Accordingly, the whole width from the first bus electrode to the second bus electrode is formed to be less than approximately 100 μm.

Assuming that the width of the conventional bus electrode is, for example, approximately 100 μm, the width of the second bus electrode formed within the discharge space is formed to be approximately 30~50 μm in the first embodiment of the present invention, thus raising the aperture ratio in the discharge cell 40. Therefore, the brightness and discharge efficiency according to the present invention are improved more than those of the conventional ITO-less electrode.

In addition, it is possible to reduce luminescent spot or boundary image sticking phenomenon by the cross-talk, since the width of the first bus electrode 30*a* formed to be completely superposed onto the first barrier rib 10 is narrower than that of the conventional electrode.

The first bus electrode and the second bus electrode are applied with the same scan signal or sustain signal and thus operate collectively as a single bus electrode.

In addition, a transparent electrode 30*d* may also be formed on the bus electrode as shown in FIG. 3B.

Figure 4A:
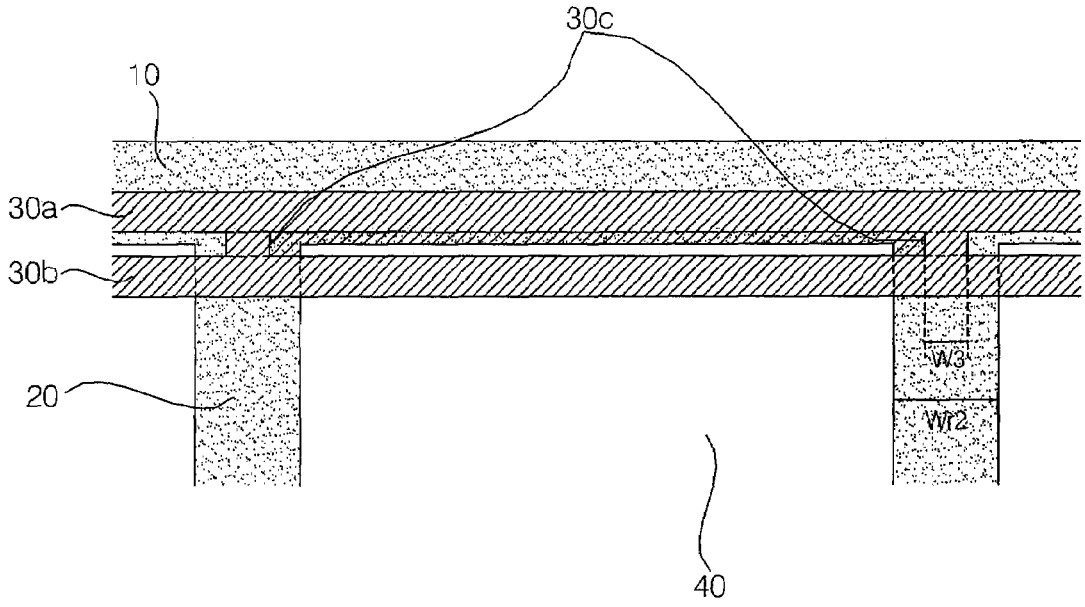
FIG. 4A is a view of illustrating an electrode structure of a plasma display panel according to a second embodiment of the present invention.
Figure 4B:
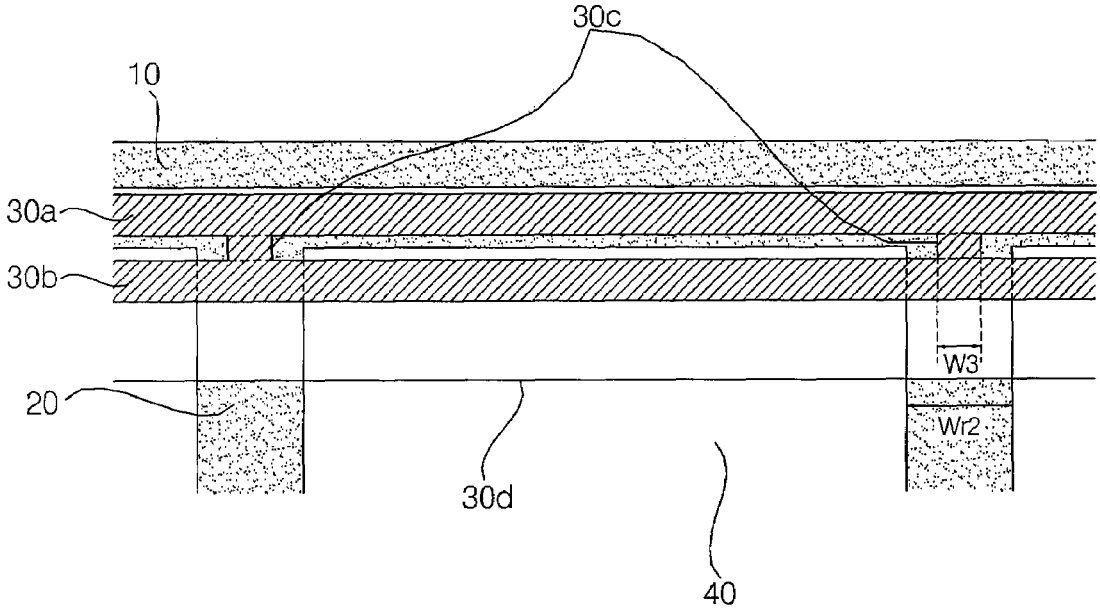
FIG. 4B is a view of illustrating an electrode structure in which transparent electrodes are formed on bus electrodes according to a second embodiment of the present invention.

FIG. 4A is a view of illustrating an electrode structure of a plasma display panel according to a second embodiment of the present invention, which illustrates a figure through which electrodes and barrier ribs are seen from the upper substrate, and FIG. 4B is a view of illustrating an electrode structure in which transparent electrodes are formed on bus electrodes according to a second embodiment of the present invention.

Basically, the second embodiment of the present invention is substantially identical to the structure of the first embodiment. However, the second embodiment according to the present invention includes a connection electrode 30*c* for connecting the first bus electrode 30*a* with the second bus electrode 30*b* in addition to the construction of the first embodiment.

The connection electrode 30*c* is formed to be completely superposed onto the second barrier 20 arranged in the direction parallel with the address electrode.

That is, the connection electrode 30*c* is formed on an upper side of the second barrier rib 20, and a width W3 of the connection electrode 20*c* is formed to be narrower than that Wr2 of the second barrier rib 20.

The width W3 of the connection electrode 30*c* can be formed to be substantially identical to or narrower than that of the first bus electrode or second bus electrode.

It is preferred that the width W3 of the connection electrode 30*c* is formed to be less than approximately 15~25 μm.

The aperture ratio of the discharge cell is not affected since the connection electrode 30*c* is formed to be completely superposed onto the second barrier rib on the upper side thereof.

In addition, forming the connection electrode 30*c* allows for reducing resistance of all the bus electrodes and increasing the amount of current flow, and thus the discharge efficiency is improved.

In addition, a transparent electrode 30*d* may also be formed on the bus electrode as shown in FIG. 4B.

Figure 5:
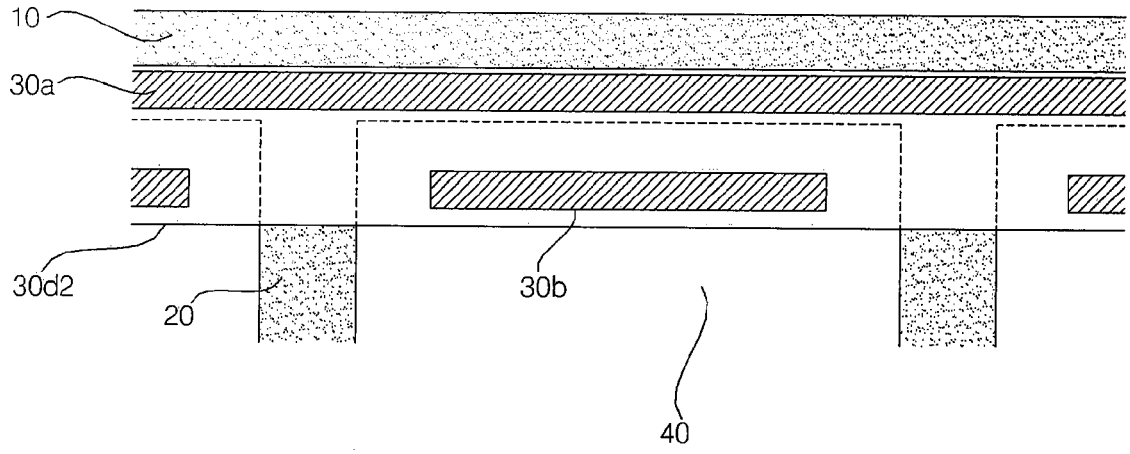
FIG. 5 is a view of illustrating an electrode structure of a plasma display panel according to a third embodiment of the present invention.

FIG. 5 is a view of illustrating an electrode structure of a plasma display panel according to a third embodiment of the present invention, which illustrates a figure through which electrodes and barrier ribs are seen from the upper substrate.

A plasma display panel according to the third embodiment of the present invention includes a scan electrode and a sustain electrode formed on an upper substrate in parallel with each other, a first barrier rib 10 formed on the lower substrate opposing the upper substrate in parallel with the scan electrode, and a second barrier rib 20 formed in the direction intersecting the first barrier rib.

In addition, the scan electrode and sustain electrode includes a transparent electrode 30*d*2, a first bus electrode 30*a* formed on the transparent electrode, and a second bus electrode 30*b*.

Here, the first bus electrode 30*a* is formed to be completely superposed onto the first barrier rib 10, and the other second bus electrode 30*b* is formed on the discharge space.

The first bus electrode 30*a* is formed in parallel with the second bus electrode 30*b*, and the second bus electrode 30*b* has discontinuities since it is not formed at the portions superposed onto the second barrier rib. That is, since the second bus electrode 30*b* is formed only on the discharge space, it is formed not to have a single integral electrode line in the transverse direction, but to to have discontinuities at the portions superposed onto the second barrier rib in every discharge cell.

Since the second bus electrode 30*b* has a discontinuous form, it is connected to the first bus electrode via the transparent electrode 30*d*2.

The transparent electrode 30*d*2 is formed to have a constant width, and the first bus electrode and the second bus electrode is formed on the transparent electrode 30*d*2 spaced by a predetermined interval.

The widths of the first and second bus electrodes are substantially identical to those of the first embodiment.

The second bus electrode 30*b* is not formed in the portions superposed onto the second barrier rib 20 in the third embodiment configured as described above, and thus the area of the portion of the second bus electrode formed within the discharge cell 40 is decreased. Therefore, the aperture ratio of the discharge cell 40 is raised, and the brightness is improved.

Figure 6:
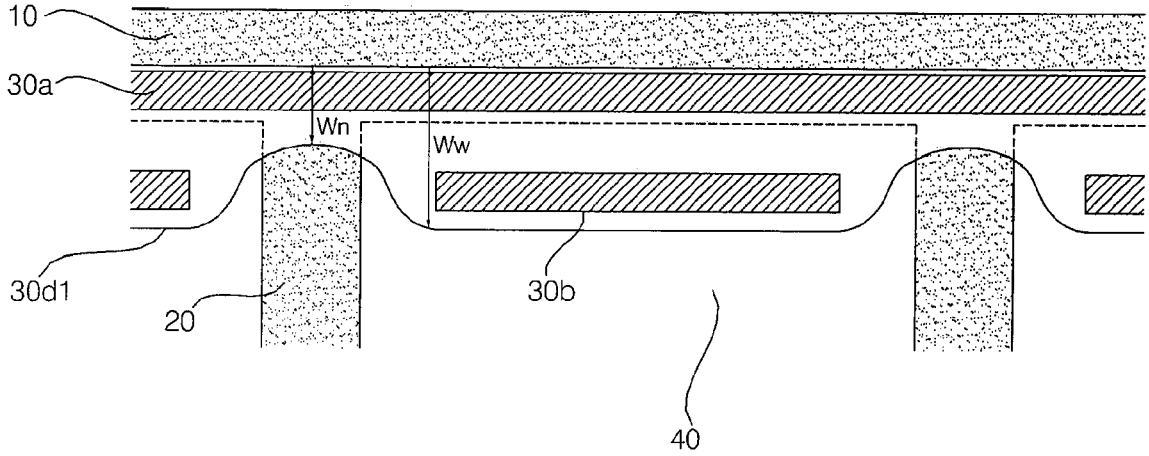
FIG. 6 is a view of illustrating an electrode structure of a plasma display panel according to a fourth embodiment of the present invention.

FIG. 6 is a view of illustrating an electrode structure of a plasma display panel according to the fourth embodiment of the present invention, which illustrates a figure through which electrodes and barrier ribs are seen from the upper substrate.

Referring to FIG. 6, the fourth embodiment of the present invention is substantially identical to the third embodiment in the basic structure, but the form of transparent 30*d*1 is different from each other.

The transparent electrode 30*d*1 is formed so that the width Wn of portion supposed onto the second barrier rib 20 is narrower than the width Ww of portion formed on the discharge space.

It is possible to reduce manufacturing costs of the transparent electrode by causing the width Wn of the portion superposed onto the second barrier rib 20 to be narrow as described above. In addition, the transparent electrode also has light screening ratio to some degree, and thus it is not formed in the portions supposed onto the second barrier. Therefore, the aperture ration can be further improved.

Figure 7:
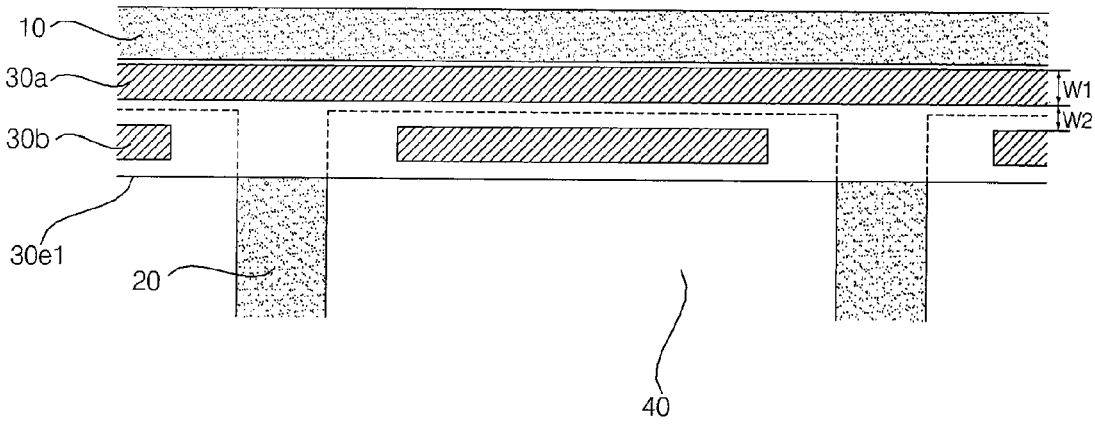
FIG. 7 is a view of illustrating an electrode structure of a plasma display panel according to a fifth embodiment of the present invention.

FIG. 7 is a view of illustrating an electrode structure of a plasma display panel according to the fifth embodiment of the present invention, which illustrates a figure through which electrodes and barrier ribs are seen from the upper substrate.

Referring to FIG. 7, the fifth embodiment of the present invention is substantially identical to the third embodiment in the basic structure, but the spacing between the first bus electrode 30*a* and the second bus electrode 30*b* is formed to be narrower than the width W1 of the first bus electrode.

The transparent electrode 30*e*1 is formed spaced in parallel with the first barrier rib 10 by a constant width, and the first and second bus electrodes are formed on the transparent electrode 30*e*1.

The first bus electrode 30*a* is formed to be completely superposed onto the first barrier rib 10.

The second bus electrode 30*b* is formed spaced in parallel with the first bus electrode 30*b* by a predetermined interval, which is narrower than the width W1 of the first bus electrode.

The width of the second bus electrode 30*b* is formed to be substantially identical to the width of the first bus electrode 30*a*.

The second bus electrode 30*b* has discontinuities in every discharge cell 40 since it is not formed at the portions superposed onto the second barrier rib 20.

As described above, the aperture ratio is improved since the second bus electrode 30*b* has discontinuities, and the interval between the electrodes 30*a*, 30*b* is formed narrow. Also, while the discharge voltage may be raised compared to the third embodiment, the discharge efficiency is improved, since a long-gab type having the wide discharge gap G is provided.

Figure 8:
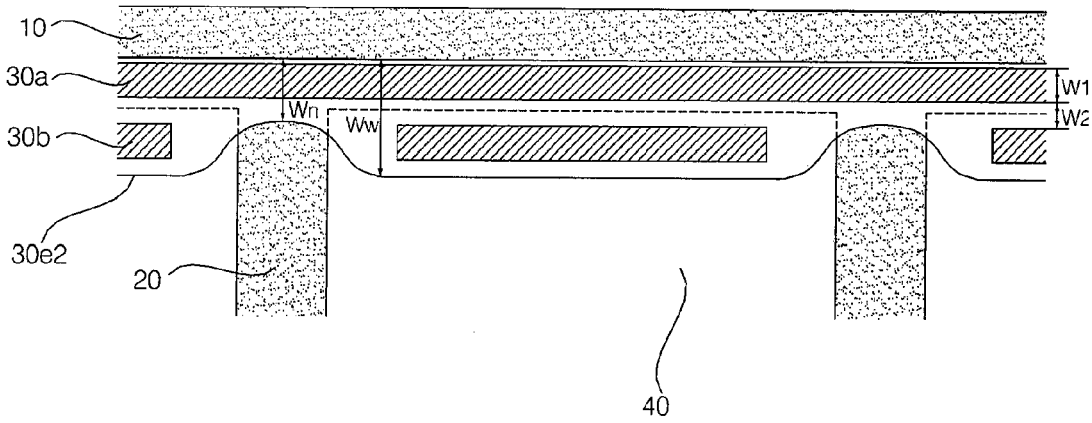
FIG. 8 is a view of illustrating an electrode structure of a plasma display panel according to a sixth embodiment of the present invention.

FIG. 8 is a view of illustrating an electrode structure of a plasma display panel according to the sixth embodiment of the present invention, which illustrates a figure through which electrodes and barrier ribs are seen from the upper substrate.

Referring to FIG. 8, the plasma display panel according to the sixth embodiment of the present invention is substantially identical to the fifth embodiment in the basic structure, but widths of the transparent electrode 30*e*2 are not constant.

That is, the transparent electrode 30*e*2 is formed so that the width Wn of portions supposed onto the second barrier rib 20 is narrower than the width Ww of portions formed on the discharge space.

It is possible to reduce manufacturing costs of the transparent electrode by causing the width Wn of the portions superposed onto the second barrier rib 20 to be narrow as described above. In addition, the transparent electrode also has light screening ratio to some degree, and thus it is not formed in the portions supposed onto the second barrier. Therefore, the aperture ratio can be further improved, thus increasing the brightness.

There is an advantage that the brightness is increased, since the area of portions of the bus electrode formed on the discharge space in the plasma display panel according to the present invention configured as described above is smaller than that of the conventional plasma display panel and thus the aperture ratio is raised. In addition, the boundary image sticking phenomenon and luminescent spot phenomenon in the non-discharge cell by cross-talk with neighboring cells can be reduced since the area of portions of the electrode superposed onto the barrier rib is also decreased. Therefore, there are effects that it is possible to improve the discharge efficiency and display images with sharper and clearer image quality.

There is also an effect that the price competition is enhanced since the manufacturing costs are reduced due to saving of the transparent electrode materials.

Although the plasma display panel according to the present invention is described with reference to the exemplary drawings, the invention is not limited to the embodiments and drawings set forth herein, rather it is limited only to the accompanying claims.

What is claimed is:

1. A plasma display panel comprising:

a first barrier rib formed on a lower substrate opposing an upper substrate in parallel with a scan electrode;

a second barrier rib formed in a direction intersecting the first barrier rib; and a sustain electrode formed on the upper substrate and in parallel with the scan electrode, wherein:

the scan electrode or the sustain electrode comprises at least two or more bus electrodes and a transparent electrode, at least one of the bus electrodes is formed over the first barrier rib, a portion of the lower substrate is covered by the transparent electrode and at least one of the bus electrodes, and each of the bus electrodes is formed in parallel with another bus electrode and spaced from another bus electrode by a predetermined interval.

2. The plasma display panel as claimed in claim 1, wherein the one or more bus electrodes other than the bus electrode formed over the first barrier rib are formed on a discharge space.

3. The plasma display panel as claimed in claim 1, wherein each of the bus electrodes is formed to substantially have the same width.

4. The plasma display panel as claimed in claim 3, wherein a width of each of the bus electrodes is less than approximately 30~50 Tm.

5. The plasma display panel as claimed in claim 1, wherein the interval between the bus electrodes is formed to be narrower than the width of each of the bus electrodes.

6. The plasma display panel as claimed in claim 1, wherein the interval is less than approximately 15~25 Tm.

7. The plasma display panel as claimed in claim 1, further comprising: a connection electrode for connecting each of the bus electrodes to one another.

8. The plasma display panel as claimed in claim 7, wherein the connection electrode is formed in parallel with the second barrier rib.

9. The plasma display panel as claimed in claim 8, wherein the connection electrode is formed to be superposed onto the second barrier rib.

10. The plasma display panel as claimed in claim 9, wherein a width of the connection electrode is formed to be narrower than of that of the second barrier rib.

11. The plasma display panel as claimed in claim 10, wherein the width of the connection electrode is formed to be substantially identical to or narrower than that of the bus electrode.

12. The plasma display panel as claimed in claim 11, wherein the width of the connection electrode is less than 15~25 Tm.

13. The plasma display panel as claimed in claim 7 wherein the portion of the lower substrate covered by the transparent electrode and at least one of the bus electrodes is also covered by the connection electrode.

14. A plasma display panel comprising:

a scan electrode and a sustain electrode formed on an upper substrate in parallel with each other;

a first barrier rib formed on a lower substrate opposing the upper substrate in parallel with the scan electrode;

a second barrier rib formed in the direction intersecting the first barrier rib such that the first and second barrier ribs define walls of a discharge cell;

first and second bus electrodes of the scan electrode or of the sustain electrode, wherein the first bus electrode is formed over the first barrier rib such that none of the first bus electrode extends over the discharge cell and the second bus electrode is formed over the discharge cell such that none of the second bus electrode extends over the first barrier rib; and a transparent electrode formed such that at least a portion of the lower substrate is covered by the transparent electrode and at least one of the first and second bus electrodes.

15. The plasma display panel as claimed in claim 14 further comprising a connection electrode which electrically connects the first and second bus electrodes and is formed extending over a portion of the discharge call and a portion of the first barrier rib.

16. The plasma display panel as claimed in claim 15 wherein the portion of the lower substrate covered by the transparent electrode and at least one of the first and second bus electrodes is also covered by the connection electrode.

17. The plasma display panel as claimed in claim 14, wherein each of the bus electrodes is formed in parallel with another bus electrode and spaced from another bus electrode by a predetermined interval.

* * * * *